US008733876B2

(12) United States Patent
Ike

(10) Patent No.: US 8,733,876 B2
(45) Date of Patent: May 27, 2014

(54) PRINTING APPARATUS

(71) Applicant: Canon Kabushiki Kaisha, Tokyo (JP)

(72) Inventor: Takeshi Ike, Ichikawa (JP)

(73) Assignee: Canon Kabushiki Kaisha, Toyko (JP)

( * ) Notice: Subject to any disclaimer, the term of this patent is extended or adjusted under 35 U.S.C. 154(b) by 0 days.

(21) Appl. No.: 13/661,410

(22) Filed: Oct. 26, 2012

(65) Prior Publication Data

US 2013/0135376 A1 May 30, 2013

(30) Foreign Application Priority Data

Nov. 29, 2011 (JP) ..... 2011-261004

(51) Int. Cl.
*B41J 29/38* (2006.01)
*B41J 29/393* (2006.01)

(52) U.S. Cl.
USPC ..... 347/14; 347/19

(58) Field of Classification Search
CPC ..... B41J 29/38
USPC ..... 347/14, 19
See application file for complete search history.

(56) References Cited

U.S. PATENT DOCUMENTS 4,550,327 A 10/1985 Miyakawa
6,168,261 B1 1/2001 Miyake et al.
6,174,039 B1 1/2001 Miyake et al.
2002/0063745 A1 * 5/2002 Osborne ..... 347/19
2007/0291067 A1 * 12/2007 Aoki et al. ..... 347/17
2010/0156982 A1 * 6/2010 Sasagawa ..... 347/14

FOREIGN PATENT DOCUMENTS

JP 58-118267 A 7/1983
JP 2-28935 A 1/1990
JP 3-194967 A 8/1991
JP 3-234636 A 10/1991
JP 6-79956 A 3/1994

* cited by examiner

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

The present invention has been made to judge the discharge state of each nozzle accurately at an appropriate timing. For this purpose, a printing apparatus using a printhead including a heater and a temperature sensor to detect a temperature of the heater has the following arrangement. A temporal change in a detected temperature is monitored upon driving the printhead. In the temperature dropping process, temperatures are extracted at plural points of a time interval including a timing at which a feature point of the temporal change in the detected temperature in normal discharge appears. The second derivative of the temperature is calculated and added to obtain a total sum. The total sum is compared with a threshold defined based on the characteristic of the temporal change in the monitored temperature in discharge failure, thereby judging whether to normally discharge ink.

6 Claims, 17 Drawing Sheets

PRINTING APPARATUS

BACKGROUND OF THE INVENTION

1. Field of the Invention

The present invention relates to a printing apparatus and, more particularly, to a printing apparatus that uses a printhead including a heating element (heater) to discharge ink.

2. Description of the Related Art

Some of inkjet printing methods of discharging ink droplets from nozzles and adhering them to a printing medium such as a paper sheet or a plastic film use a printhead including a heater that generates heat energy to discharge ink. For a printhead according to this method, for example, electrothermal transducers, a driving circuit thereof, and the like, can be formed using the same process as a semiconductor manufacturing process. Hence, the printhead has the advantages of facilitating high-density nozzle integration and achieving high-resolution printing.

In this printhead, an ink discharge failure may occur in some or all of the nozzles of the printhead due to nozzle clogging caused by foreign substances or high viscosity ink, bubbles trapped in an ink supply channel or a nozzle, a change in wettability on a nozzle surface, or the like. To avoid degradation of image quality caused by such a discharge failure, it is preferable to quickly execute a recovery operation of recovering the ink discharge state or a complementary operation by another nozzle. However, to quickly perform these operations, it is very important to judge an ink discharge state or a discharge failure occurrence accurately at an appropriate timing.

Hence, there have conventionally been proposed various ink discharge state judgment methods and complementary printing methods and apparatuses using them.

As a printing method of detecting a printed product and obtaining a faultless image, Japanese Patent Laid-Open No. 6-079956 discloses an arrangement for printing a predetermined pattern on a detection paper sheet, causing a reading apparatus to read it, and detecting an abnormal printing element. According to Japanese Patent Laid-Open No. 6-079956, image data that should be used for an abnormal printing element is moved and superimposed on image data to be used by another printing element, and complementary printing is performed to obtain a faultless image.

Japanese Patent Laid-Open No. 3-234636 discloses an arrangement using a full-line printhead corresponding to a printing medium width, in which a detection means (reading head) for detecting whether or not ink has been discharged is provided to uniform the discharge states of nozzles arrayed in the widthwise direction of the printing medium. Japanese Patent Laid-Open No. 3-234636 also discloses an arrangement for setting appropriate control based on a nozzle driving condition at the time of detection.

As a method of detecting ink droplet discharge, Japanese Patent Laid-Open No. 3-194967 discloses an arrangement for causing a detection means including a set of a light-emitting element and a light-receiving element which are arranged at one end and the other end of the nozzle array of a printhead to determine the ink droplet discharge state of each nozzle.

Japanese Patent Laid-Open No. 58-118267 discloses a method of arraying heat conductors at positions affected by heat generated by heaters and detecting a change in the resistance value of each heat conductor, which changes depending on the temperature, that is, performing detection on the ink discharge source side, instead of directly detecting the ink discharge state.

As an arrangement for similarly performing detection on the ink discharge source side, Japanese Patent Laid-Open No. 2-28935 discloses an arrangement in which heaters and temperature detection elements are provided on a single support base (heater board) such as an Si (silicon) substrate. Japanese Patent Laid-Open No. 2-28935 also discloses providing temperature detection elements that have film-like shape and overlap heater array regions. In addition, Japanese Patent Laid-Open No. 2-28935 discloses an arrangement for judging ink discharge failure based on a change in the resistance value of a temperature detection element according to a temperature change. Also described is forming a temperature detection element having film-like shape on a heater board by a film forming process and connecting the temperature detection element to the outside via a terminal by a method such as wire bonding.

In the discharge state judgment method disclosed in Japanese Patent Laid-Open No. 6-079956, however, it is very difficult to quickly judge the discharge state because a nozzle with a discharge failure is detected based on the reading result of a check pattern printed on a paper sheet, assuming that the check pattern is printed prior to the judgment. In addition, a reading apparatus needs to be provided, and accordingly, the printing apparatus becomes bulky and expensive.

In the arrangements disclosed in Japanese Patent Laid-Open Nos. 3-234636 and 3-194967 as well, the apparatus has difficulty in downsizing and cost reduction. It is also difficult to quickly detect a nozzle having discharge failure.

In the arrangements disclosed in Japanese Patent Laid-Open Nos. 58-118267 and 2-28935, the problems of Japanese Patent Laid-Open Nos. 6-079956, 3-234636, and 3-194967 are supposedly relaxed. However, the arrangements are still insufficient for accurately judging the discharge state. Especially, in Japanese Patent Laid-Open No. 2-28935, it is impossible to accurately specify a nozzle with discharge failure.

SUMMARY OF THE INVENTION

Accordingly, the present invention is conceived as a response to the above-described disadvantages of the conventional art.

For example, a printing apparatus according to this invention is capable of executing judgment of the discharge state of each nozzle or judgment of discharge failure occurrence accurately at an appropriate timing while suppressing an apparatus from becoming bulky and expensive.

According to one aspect of the present invention, there is provided a printing apparatus comprising: a printhead including a heater configured to generate heat energy to discharge ink, and a temperature sensor configured to detect a temperature; a driving unit configured to drive the heater; a monitoring unit configured to monitor a temporal change in the temperature detected by the temperature sensor when the driving unit drives the heater; an extraction unit configured to, in a temperature dropping process in a driving period of the heater monitored by the monitoring unit, extract temperatures at a plurality of points of a predetermined time interval including a timing at which a feature point of the temporal change, in the temperature detected by the temperature sensor, which occurs when the ink is normally discharged by driving the heater, appears; an arithmetic unit configured to calculate a second derivative of the temperature extracted by the extraction unit in respect with a time; an addition unit configured to acquire a total sum of values of second derivatives calculated by the arithmetic unit, which are weighted in accordance with an elapse of time; and a judgment unit configured to judge, based on a predetermined first threshold and the total sum acquired by the arithmetic unit, whether normal discharge is obtained, or discharge failure has occurred.

The invention is particularly advantageous since it is possible to execute judgment of the discharge state of each nozzle or judgment of discharge failure occurrence accurately at an appropriate timing while suppressing an apparatus from becoming bulky and expensive.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") generically means an ink orifice or a liquid channel communicating with it, and an element for generating energy used to discharge ink, unless otherwise specified.

<Description of Printing Apparatus (FIG. 1)>

The arrangement of an inkjet printing apparatus (to be referred to as a printing apparatus hereinafter) commonly applicable to several embodiments to be described below will be explained.

Figure 1:
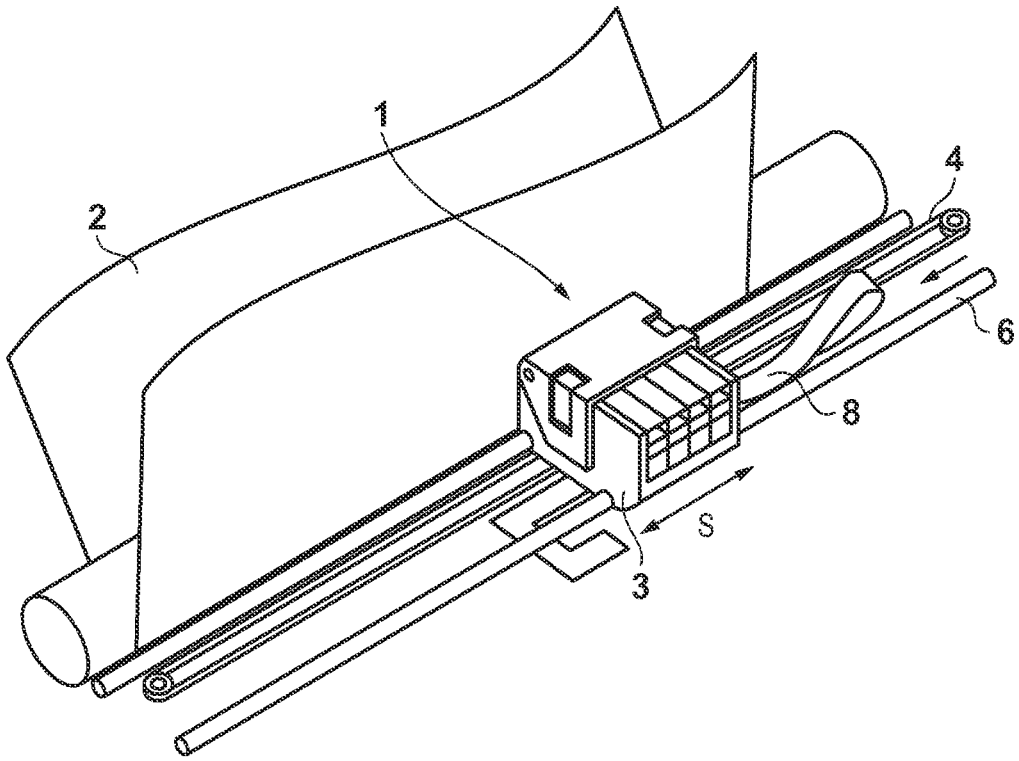
FIG. 1 is a perspective view showing the main mechanism portion of an inkjet printing apparatus according to a typical embodiment of the present invention.

FIG. 1 is a perspective view showing the outline of the main mechanism portion of a printing apparatus according to a typical embodiment of the present invention, which has an inkjet printhead (to be referred to as a printhead hereinafter) mounted on it and discharges ink to a printing medium to perform printing. As shown in FIG. 1, a printhead 1 is mounted on a carriage 3. The carriage 3 is guided and supported to be reciprocally movable in the direction indicated by an arrow S along a guide rail 6 in accordance with rotation of a timing belt 4. The printhead 1 includes, on a surface facing a printing medium 2, a group of nozzles arrayed in a direction different from the moving direction of the carriage 3. In the process of reciprocal scanning of the carriage 3 with the printhead 1 mounted in the direction of the arrow S, the nozzle group of the printhead 1 discharges ink in accordance with print data, thereby performing printing on the printing medium 2.

A plurality of printheads 1 can be provided in consideration of discharging inks of a plurality of colors. For example, printing can be performed using cyan (C), magenta (M), yellow (Y), and black (Bk) inks. The printhead 1 may integrally include a separable or inseparable ink tank storing ink. Alternatively, the printhead may receive ink, via a tube or the like, supplied from an ink tank provided at a fixed portion of the apparatus. The carriage 3 is provided with an electrical connection portion that transmits a driving signal or the like to the printhead 1 via a flexible cable 8 and a connector.

Although not illustrated in FIG. 1, a recovery unit used to maintain or recover the ink discharge operation of the nozzles of the printhead to a satisfactory state is provided within the moving range of the printhead and outside the printing range of the printing medium 2. A recovery unit having a known arrangement can be employed. For example, the recovery unit can include a cap that caps the nozzle formation surface of the printhead, and a pump that forces the nozzles to discharge the ink into the cap by applying a negative pressure in the capping state. The recovery unit may cause the nozzles to perform preliminary discharge of ink into, for example, the cap, which does not contribute image printing.

<Arrangement of Printhead (FIGS. 2A, 2B and 3)>

Figure 2A:
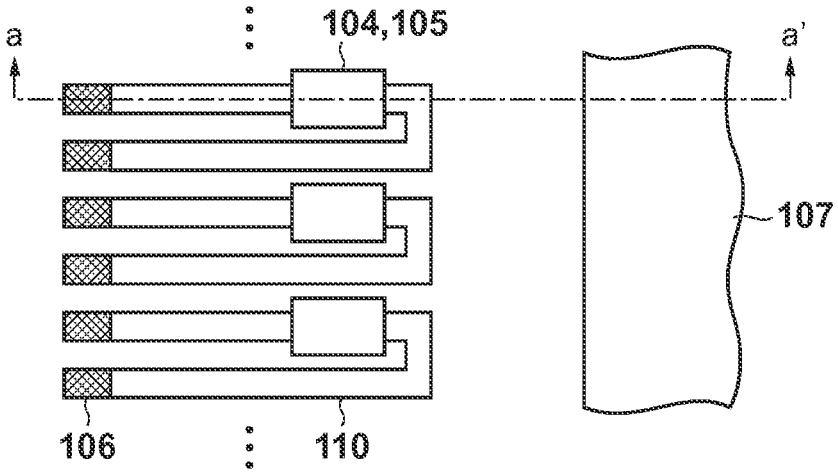
FIGS. 2A and 2B are a schematic plan view showing part of the board (heater board) of an inkjet printhead including temperature detection elements and a schematic sectional view taken along a line a-a', respectively.
Figure 2B:
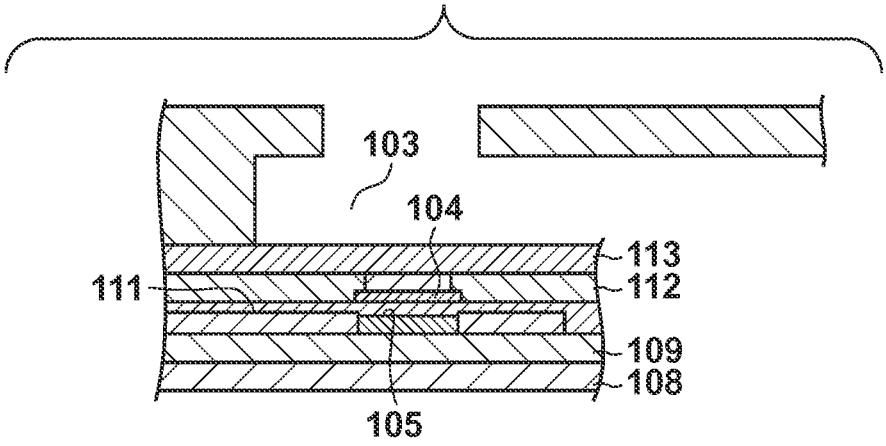

FIGS. 2A and 2B are a schematic plan view showing part of the board (heater board) of a printhead including temperature detection elements and a schematic sectional view taken along a line a-a', respectively.

A power is supplied by a driving pulse signal to cause each of a plurality of nozzles 103 provided in a line to discharge ink. Accordingly, electrothermal transducers (to be referred to as heaters hereinafter) 104 are heated to, for example, cause film boiling in the ink so that each nozzle discharges an ink droplet.

Referring to the plan view of FIG. 2A, a terminal 106 is connected to the outside by wire bonding and supply the power. A temperature detection element (to be referred to as a temperature sensor hereinafter) 105 is formed on the heater board by the same film forming process as that of the heaters 104. Reference numeral 107 denotes a common ink chamber.

As shown in the sectional view of FIG. 2B, the temperature sensor 105 formed from a thin-film resistor whose resistance value changes depending on the temperature is arranged on a heat storage layer 109 formed from a thermal oxide film of $SiO_2$ on an Si substrate 108 included in the heater board. The temperature sensor 105 is made of Al, Pt, Ti, Ta, Cr, W, AlCu, or the like. Interconnections 110 of Al or the like, which include individual interconnections for the heaters 104 and interconnections that connect the heaters 104 to a control circuit for selectively supplying a power to them, are also formed on the Si substrate 108. In addition, the heaters 104, a passivation film 112 of SiN or the like, and an anti-cavitation film 113 are stacked at a high density by the same process as a semiconductor manufacturing process and arranged on an interlayer insulation film 111. Note that Ta or the like can be used for the anti-cavitation film 113 to increase the anti-cavitation capability on the heaters 104.

The temperature sensors 105 formed as thin-film resistors are arranged immediately under (adjacent to) the heaters 104 independently in a one-to-one correspondence as many as the heaters 104. The heaters 104 can be formed as part of the individual interconnections 110 connected to the temperature sensors 105. This allows to manufacture the heater board without largely changing the conventional structure, resulting in a large advantage for production.

Figure 3:
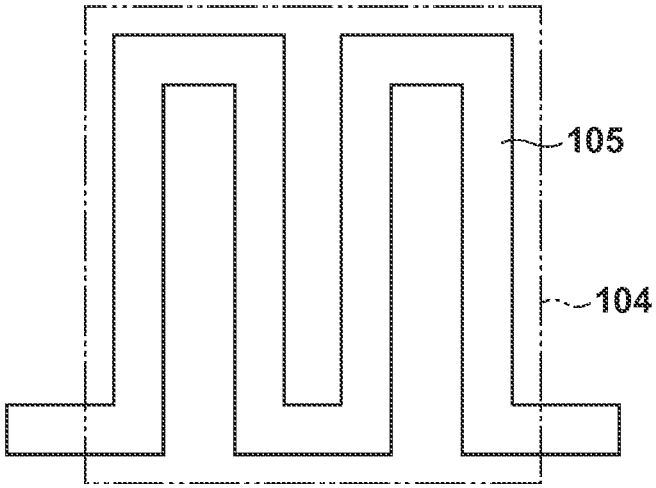
FIG. 3 is a schematic plan view showing another example of the shape of the temperature sensor that can be formed on the heater board shown in FIGS. 2A and 2B.

The planar shape of the temperature sensor 105 can appropriately be defined. The temperature sensor may have a rectangular shape having the same size as that of the heater 104, as shown in FIG. 2A, or a serpentine shape as shown in FIG. 3. This makes it possible to increase the resistance of the temperature sensor 105 and obtain a high detection value even from a small temperature variation.

<Control Arrangement (FIG. 4)>

Figure 4:
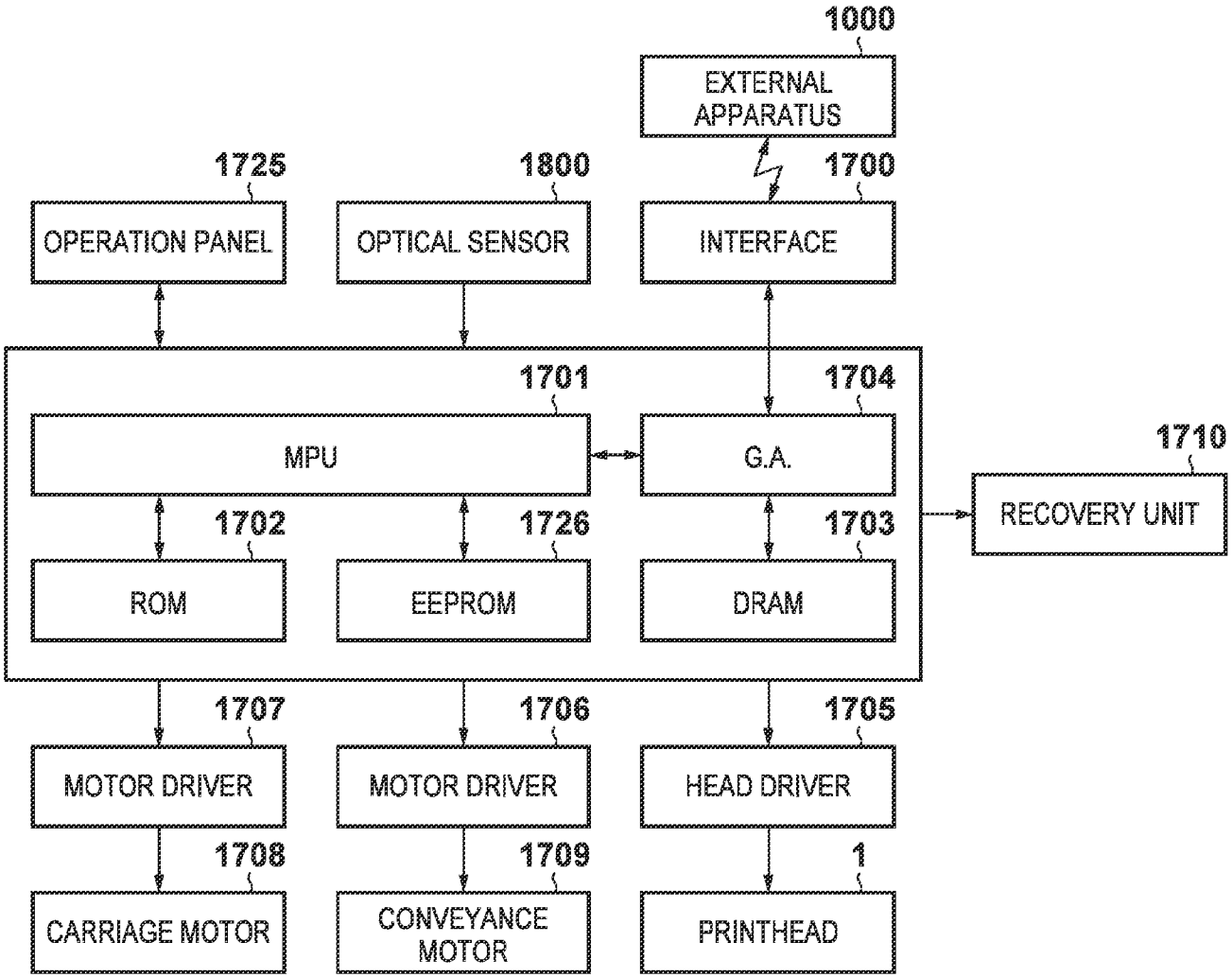
FIG. 4 is a block diagram showing the control arrangement of a printing system including the printing apparatus shown in FIG. 1.

FIG. 4 is a block diagram showing the control arrangement of a printing system including the printing apparatus shown in FIG. 1.

Referring to FIG. 4, an interface 1700 receives a command or a print signal including image data sent from an external apparatus 1000 having the form of a host computer or other device as needed. In addition, the status information of the printing apparatus can be sent from the interface 1700 to the external apparatus 1000 as needed. An MPU 1701 controls the units in the printing apparatus in accordance with necessary data and control programs corresponding to processing procedures to be described later, which are stored in a ROM 1702.

A DRAM 1703 stores various kinds of data (the print signal, print data to be supplied to the printhead, and the like). A gate array (G.A.) 1704 controls print data supply to the printhead 1 and also controls data transfer between the interface 1700, the MPU 1701, and the DRAM 1703. A nonvolatile memory 1726 such as an EEPROM is used to save necessary data even in the power off state of the printing apparatus.

A carriage motor 1708 is used to reciprocally move the carriage 3 in the direction of the arrow, as shown in FIG. 1. A conveyance motor 1709 is used to convey the printing medium 2. A head driver 1705 drives the printhead 1. Motor drivers 1706 and 1707 drive the conveyance motor 1709 and the carriage motor 1708, respectively. A recovery unit 1710 can be the above-described recovery unit including a cap, a pump, and the like. An operation panel 1725 includes a setting input unit that allows an operator to do various kinds of settings in the printing apparatus, a display unit that displays a message for the operator, and the like. An optical sensor 1800 detects, for example, the conveyance position of the printing medium.

<Principle of Discharge State Judgment>

The printhead to which the present invention is applied basically includes a heating element (heater) that generates heat energy to discharge ink, and a temperature detection element (temperature sensor) that detects a temperature change according to driving of the heater. In a first method to be described below, first, in the dropping process of the temperature detected by the temperature sensor in the temperature change during the driving period of heater driving, pieces of temperature information at a plurality of points in an extraction interval generated upon normal ink discharge are extracted as extraction data. Next, the total sum of the absolute values of the differences between the addition threshold and the second derivatives of the temperature change curves at the plurality of points of the extraction data is calculated. Based on the calculated total sum and a predetermined total sum threshold, the ink discharge state is judged.

As a second method, each of the second derivatives at the plurality of points is compared with the addition threshold. The total sum of the absolute values of the differences between the addition threshold and the second derivatives at points judged to be smaller than the addition threshold as the result of comparison is calculated. Based on the total sum and the total sum threshold, the ink discharge state is judged.

The principle will be described below in detail.

Figure 5:
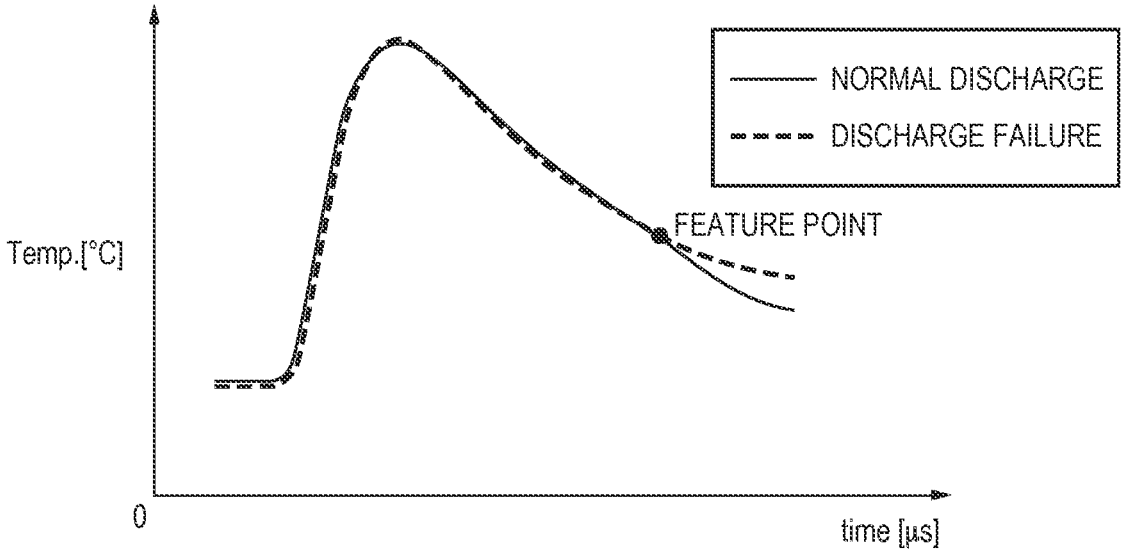
FIG. 5 is a graph showing the temporal change in a temperature detected by a temperature sensor in normal ink discharge and a discharge failure.

FIG. 5 is a graph showing the temporal change in a temperature detected by the temperature sensor in normal discharge when ink discharge is performed normally and in a discharge failure when ink discharge failure has occurred.

A temperature change (indicated by the solid line) in normal discharge will be described first.

According to FIG. 5, when a pulse voltage is applied to the heater 104, the temperature of the heater 104 abruptly rises. Accordingly, the temperature of the interface between the ink and the anti-cavitation film also rises. When the temperature of the interface between the ink and the anti-cavitation film has reached the bubbling (boiling) temperature of the ink, bubbles form and grow. At this time, the portion of the anti-cavitation film 113 immediately above the heater 104 is not in contact with the ink because of the bubble generation. The heat conductivity of the bubbles is lower than that of the ink by about one order of magnitude. For this reason, the heat is poorly conducted to the ink side when the bubbles are present immediately above the heater 104.

When the voltage pulse application stops, the temperature of the temperature sensor 105 drops from the highest temperature. The bubbles gradually shrink as the heat is lost. When a difference is generated between the pressure in the bubbles and the atmospheric pressure, the ink flows from the orifice side to the bubbles/heater board side. As a result, the ink on the upper side of the bubble center comes into contact with the anti-cavitation film 113 before complete defoaming. When the ink having the high heat conductivity comes into contact with the anti-cavitation film 113, the heat is transferred from the heater board to the ink, and the temperature sensor 105 on the heater board side is abruptly cooled down. Hence, an abrupt change occurs in the cooling temperature in the dropping process of the temperature detected by the temperature sensor 105.

A temperature change (indicated by the broken line) in a discharge failure will be described next.

When the nozzles are clogged with dust, or the ink near the nozzles thickens, it may be impossible to discharge the ink. Even in this case, the temperature rises along with the voltage pulse application to the heater 104, as in normal discharge, as shown in FIG. 5. When the temperature of the interface between the ink and the anti-cavitation film has reached the bubbling temperature of the ink, bubbles form and grow. However, since the nozzles or ink orifices are clogged up, the bubbles grow to the upstream side of the ink supply direction due to the high flow resistance in the discharge direction. The bubbles disappear along with the elapse of time. However, the phenomenon in which only the ink on the upper side of the bubble center comes into contact with the anti-cavitation film 113 does not occur because no ink flow by discharge occurs. Hence, the interface between the ink and the anti-cavitation film gradually shrinks, and no abrupt change occurs in the cooling temperature in the dropping process of the temperature detected by the temperature sensor 105. It is therefore possible to judge the presence/absence of normal discharge based on the presence/absence of the abrupt change in the cooling temperature. Note that there is a branching point between the temperature profiles in the normal discharge and the discharge failure in the temperature dropping process in FIG. 5. This branching point is called a feature point hereinafter.

Figure 6:
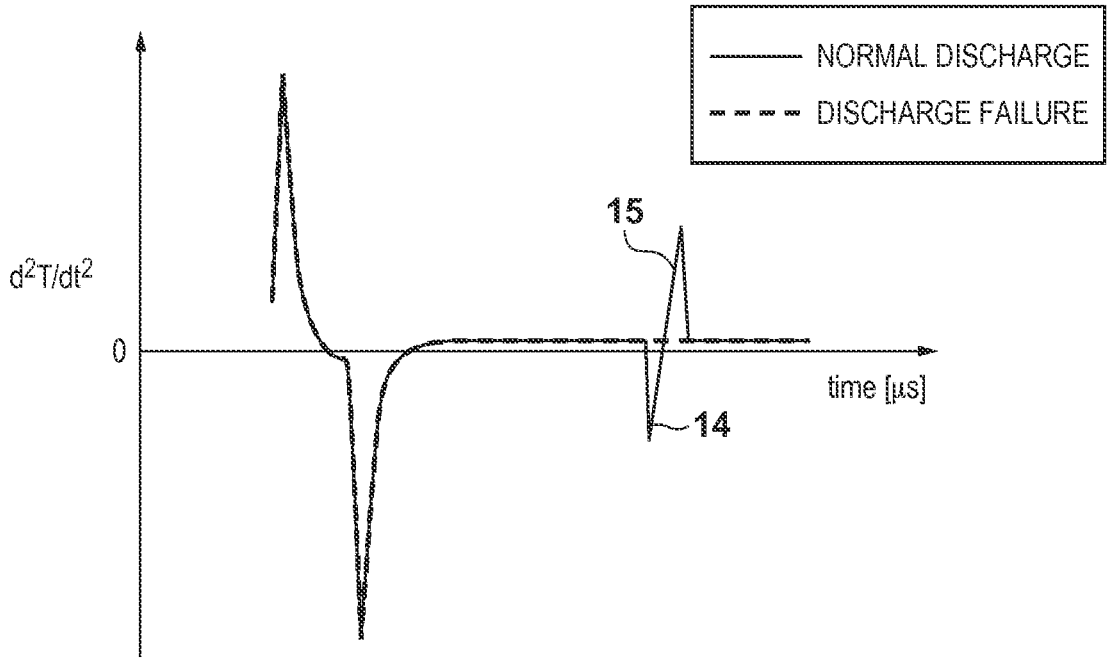
FIG. 6 is a graph showing the temporal change in the second derivative of the temperature in respect with a time shown in FIG. 5.

FIG. 6 is a graph showing the temporal change in the second order differential of the temperature shown in FIG. 5.

In the normal discharge of the ink, since the cooling temperature abruptly changes in the temperature dropping process, a characteristic in which a negative peak (minimum value) 14 and a positive peak (maximum value) 15 appear exists. The feature point appears near the negative peak and the positive peak. On the other hand, in the discharge failure, these peaks do not appear. For this reason, based on the result obtained by calculating the second order differential of the temperature change with respect to the time, for example, depending on whether or not the negative peak 14 exists, whether or not the abrupt change in the cooling temperature has occurred, that is, whether or not normal discharge has been performed can be detected.

Several embodiments of ink discharge state judgment will be described below.

First Embodiment

Figure 7:
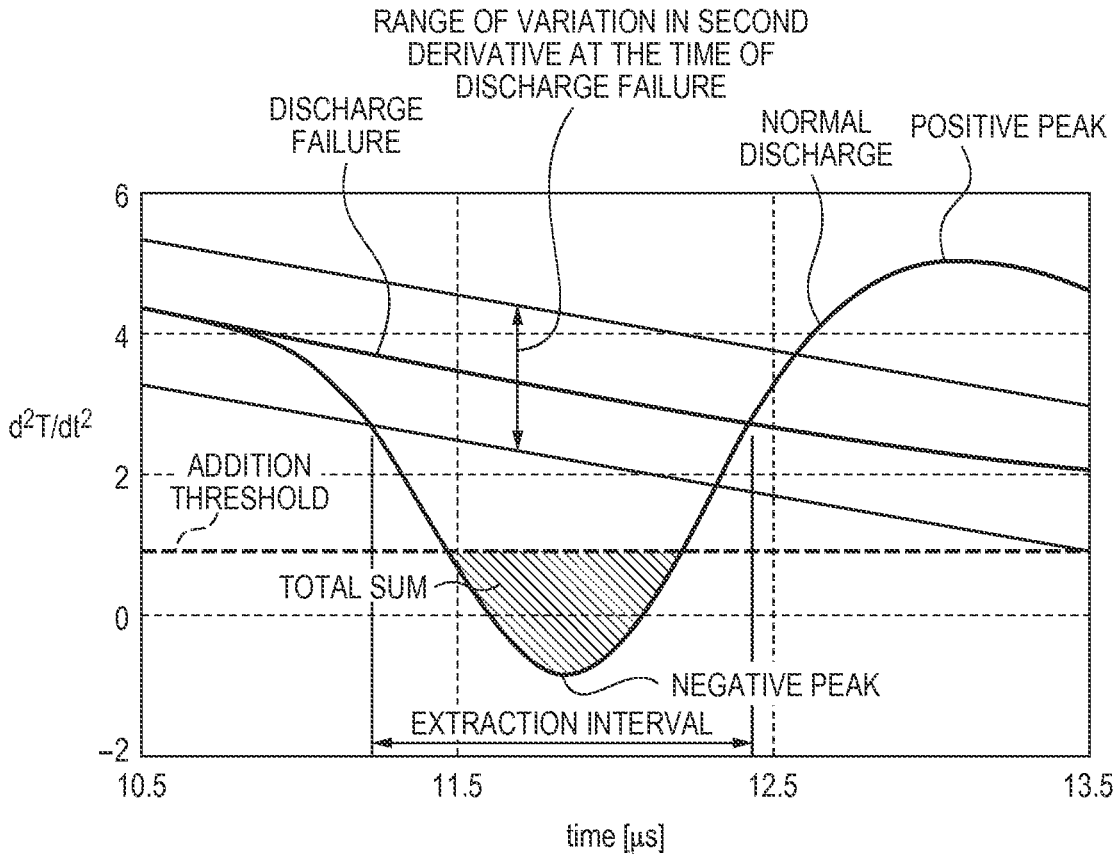
FIG. 7 is a graph showing the relationship between a threshold defined based on the second derivative ($d^2T/dt^2$) of the detected temperature in respect with a time at the time of a discharge failure occurrence and the second derivatives of the detected temperature in respect with a time at the time of normal discharge and at the time of a discharge failure occurrence according to the first method of the present invention.

FIG. 7 is a graph showing the relationship between an addition threshold and the second derivatives ($d^2T/dt^2$) of the temperature detected by a temperature sensor 105 in respect with a time at the time of normal discharge and at the time of a discharge failure occurrence according to the first method. In FIG. 7, T is a temperature, and t is a time.

In the normal discharge, the negative peak that appears in the second derivative has a smaller value, and the positive peak has a larger value than in the second derivative at the time of the discharge failure. Hence, if the second derivative is added without using the addition threshold, the negative peak and the positive peak cancel each other, and the difference from that at the time of the discharge failure is not so large. In addition, the waveform of the temperature detected by the temperature sensor 105 has a variation caused by the difference in the head or nozzle. In this method, the addition threshold is set in consideration of the second derivative at the time of the discharge failure and its variation as well, and the total sum of the second derivatives equal to or smaller than the threshold is obtained.

Discharge State Judgment Procedure (1)

Figure 8:
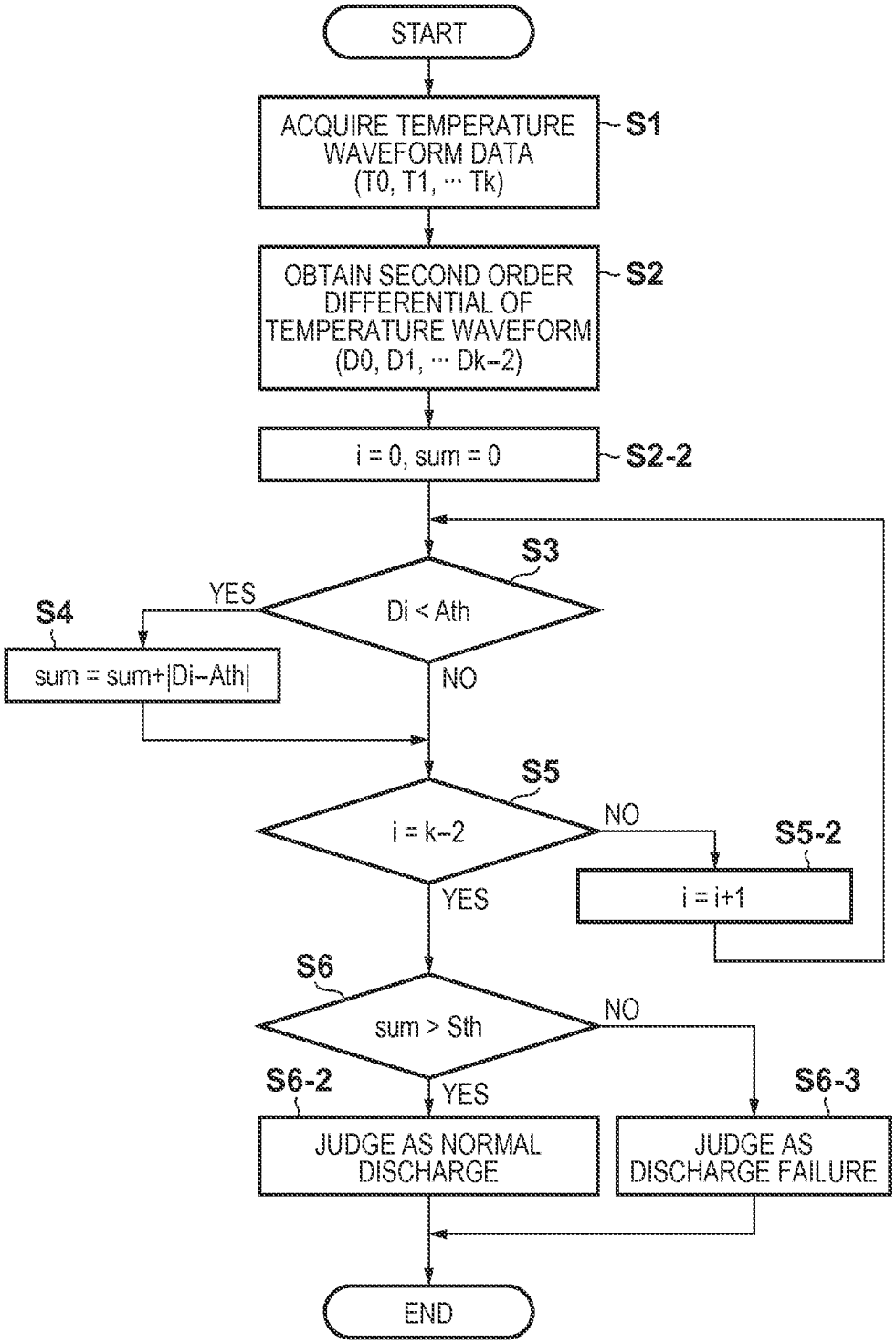
FIG. 8 is a flowchart showing a discharge state judgment procedure according to the first method of the present invention.

FIG. 8 is a flowchart showing a discharge state judgment procedure according to the first method.

In step S1, temperature waveform data T0, T1, T2, . . . , Tk at (k+1) points within the temperature data extraction interval generated when the ink is normally discharged in the dropping process of the temperature obtained by temperature monitoring are acquired. Note that the value k can be determined appropriately considering the discharge state judgment accuracy to be obtained or the like.

In step S2, the second order differentials of the temperature waveform data obtained in step S1 are calculated to acquire second order differential waveform data D0, D1, D2, . . . , Dk−2.

In step S2-2, a parameter i to be used in the following processing and a value sum to be used in total sum calculation are reset to 0 (zero).

In step S3, data Di at a point in the second derivative obtained in step S2 is compared with an addition threshold Ath. If Di<Ath, the process advances to step S4. If Di≥Ath, the process advances to step S5. Only second derivatives having values smaller than the addition threshold Ath are thus selected as the addition target.

In step S4, the absolute value |Di−Ath| of the difference between the addition threshold Ath and the data Di at the point in the second derivative obtained in step S2 is added to sum.

In step S5, it is judged based on the parameter i whether or not the comparison of step S3 has been ended for the data at all points in the second derivative. In affirmative judgment (YES), the process advances to step S6. In negative judgment (NO), the parameter i is incremented by one in step S5-2, and the process returns to step S3.

In step S6, the value sum is compared with a total sum Sth. If sum>Sth, it is judged that the ink is normally discharged (step S6-2). If sum≤Sth, it is judged that discharge failure has occurred (step S6-3).

The above-described discharge failure judgment processing can be performed for all nozzles at an appropriate timing. For example, this processing can be executed during the printing operation or at the time of preliminary discharge. At any time, since the discharge state judgment is executed in association with the ink discharge operation of each nozzle, this processing can be executed at an appropriate timing, and a nozzle with a discharge failure can correctly be specified. In addition, recovery processing can quickly be executed in response to detection of discharge failure, or a complementary printing operation by another nozzle can quickly be executed. Furthermore, decision of an optimum driving pulse, processing of protecting the printhead from temperature rise, warning to a user, and the like can also promptly be executed.

If the timing at which a feature point appears does not vary, the total sum at the time of the discharge failure is close to 0 (zero), although it may have some value due to the influence of noise. On the other hand, at the time of normal discharge, the influence of the positive peak is eliminated, and the negative peak is calculated as the total sum. Hence, when the discharge is normally performed, the value of the total sum is larger than in the discharge failure. It is therefore possible to accurately discriminate a case in which the discharge is normally done from a case in which discharge failure has occurred.

However, the timing at which a feature point of a normal temperature waveform appears varies due to the variation in the nozzle shape or the like. A shift from the temperature waveform extraction time (period) set in the printing apparatus main body may occur. As a result, the total sum in the normal discharge state becomes small, and the total sum in the discharge failure state becomes large. At this time, a total sum that exceeds the total sum threshold exists. Consequently, a judgment error may occur in both normal judgment and discharge failure judgment.

In an attempt to increase image quality in inkjet printing, judging a discharge failure as normal discharge is more problematic than judging normal discharge as a discharge failure. If normal discharge is erroneously judged as a discharge failure, image correction is performed by correction printing using nozzles around the erroneously judged nozzle. However, if discharge failure is erroneously judged as normal discharge, printing is performed with a problem such as missing dots remaining unsolved.

Figure 9:
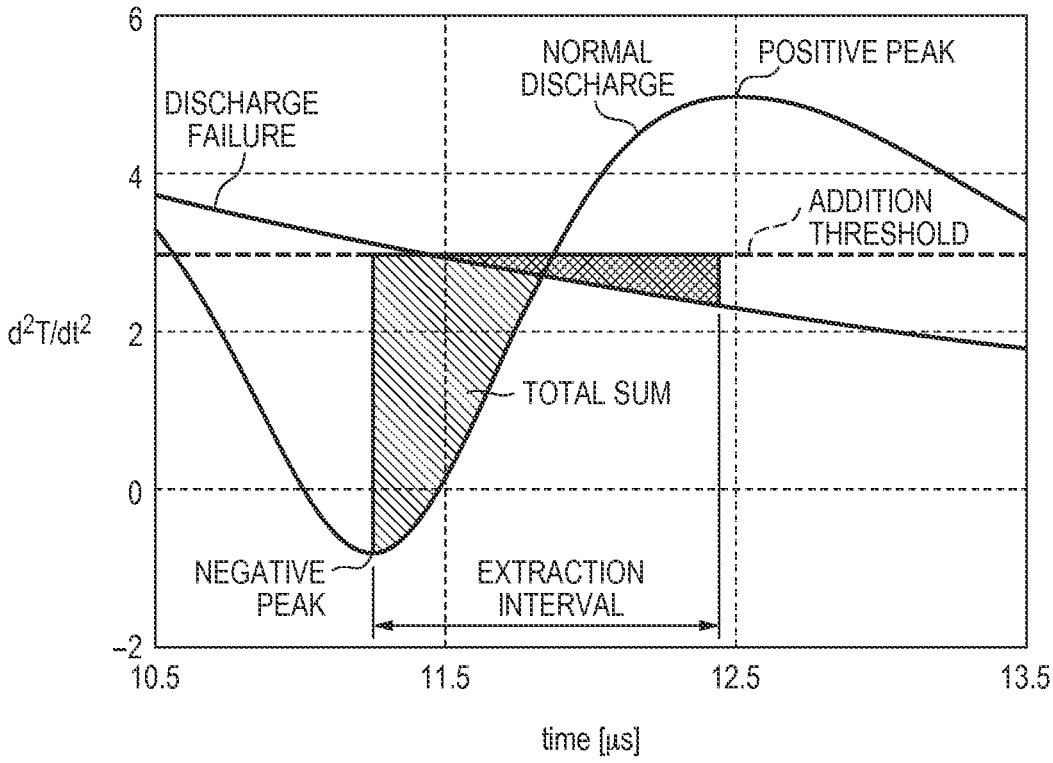
FIG. 9 is a graph showing the second derivative ($d^2T/dt^2$) of the temperature in respect with a time when the timing at which a feature point appears earlier by 0.6 μsec with respect to the extraction interval.

FIG. 9 is a graph showing the second derivative ($d^2T/dt^2$) of the temperature in respect with a time when the timing at which a feature point appears earlier by 0.6 μsec with respect to the extraction interval. The value of the second derivative at the time of a discharge failure becomes small along with the elapse of time. As the value of the second derivative becomes smaller, the second derivative becomes smaller than the addition threshold. This is the reason why the total sum becomes large.

As is apparent from this graph, the total sum at the time of the discharge failure can be made smaller by making the addition portion lower from the first half toward the second half of the extraction interval (period). The value of the second derivative in the discharge failure tends to decrease along with the time. For this reason, when the timing at which a feature point variation appears is earlier with respect to the extraction interval, the total sum can be made small as compared to the addition portion is always constant.

Figure 10:
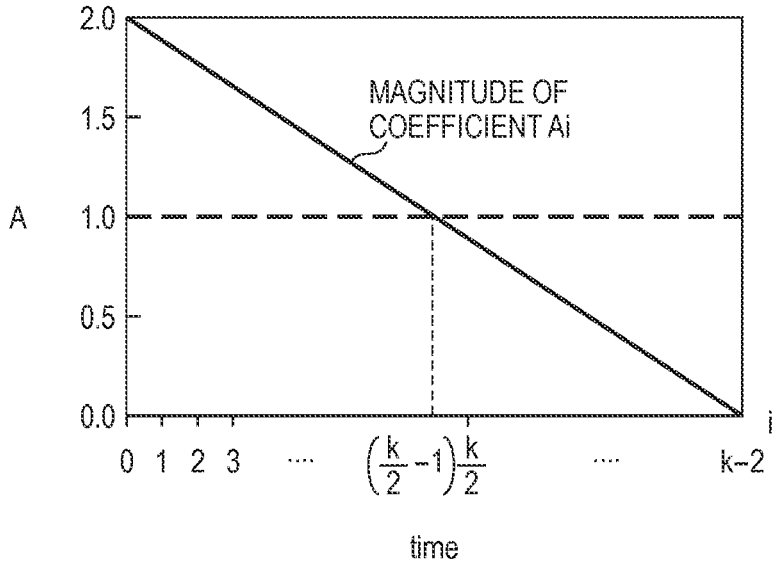
FIG. 10 is a graph showing an example of a coefficient when making the addition portion lower from the first half toward the second half of the extraction interval.

FIG. 10 is a graph showing an example of a weighting coefficient when making the addition portion lower from the first half toward the second half of the extraction interval. According to FIG. 10, the second derivative is added at a double ratio to the second order differential waveform data at the start of the extraction interval. However, the second derivative is added at a zero (0) ratio to the second order differential waveform data at the end of the extraction interval. In addition, as for the addition portion for the second order differential waveform data in the entire extraction interval, coefficients A0, A1, A2, . . . , Ak−2 are decreased along with the time with respect to the second order differential waveform data D0, D1, D2, . . . , Dk−2, as represented by Ai=2*(1−i/(k−2)) (i=0, 1, . . . , k−2: k is an even number).

Second Embodiment

Discharge State Judgment Procedure (2)

Figure 11:
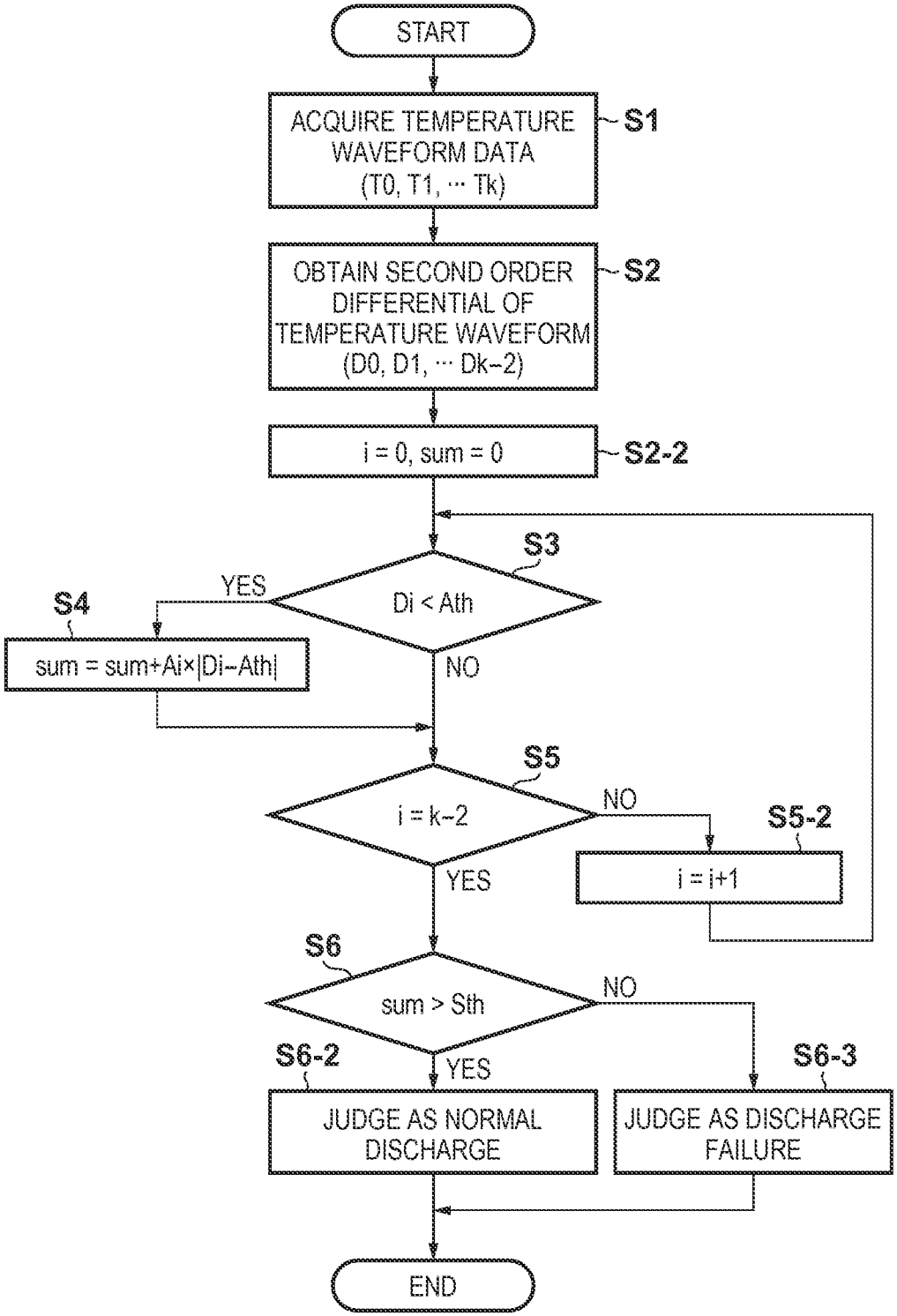
FIG. 11 is a flowchart showing a discharge state judgment procedure according to the second embodiment.

FIG. 11 is a flowchart showing a discharge state judgment procedure according to the second embodiment.

As can be seen by comparing FIG. 11 with FIG. 8, step S4 is different from the first embodiment. In step S4, the absolute value of the difference between the addition threshold and data Di at a point in the second derivative obtained in step S2, on which predetermined coefficients A0, A1, A2, . . . , Ak−2 are multiplied, is added to sum. The rest of the processing is the same as that described with reference to FIG. 8, and a description thereof will be omitted.

Figure 12:
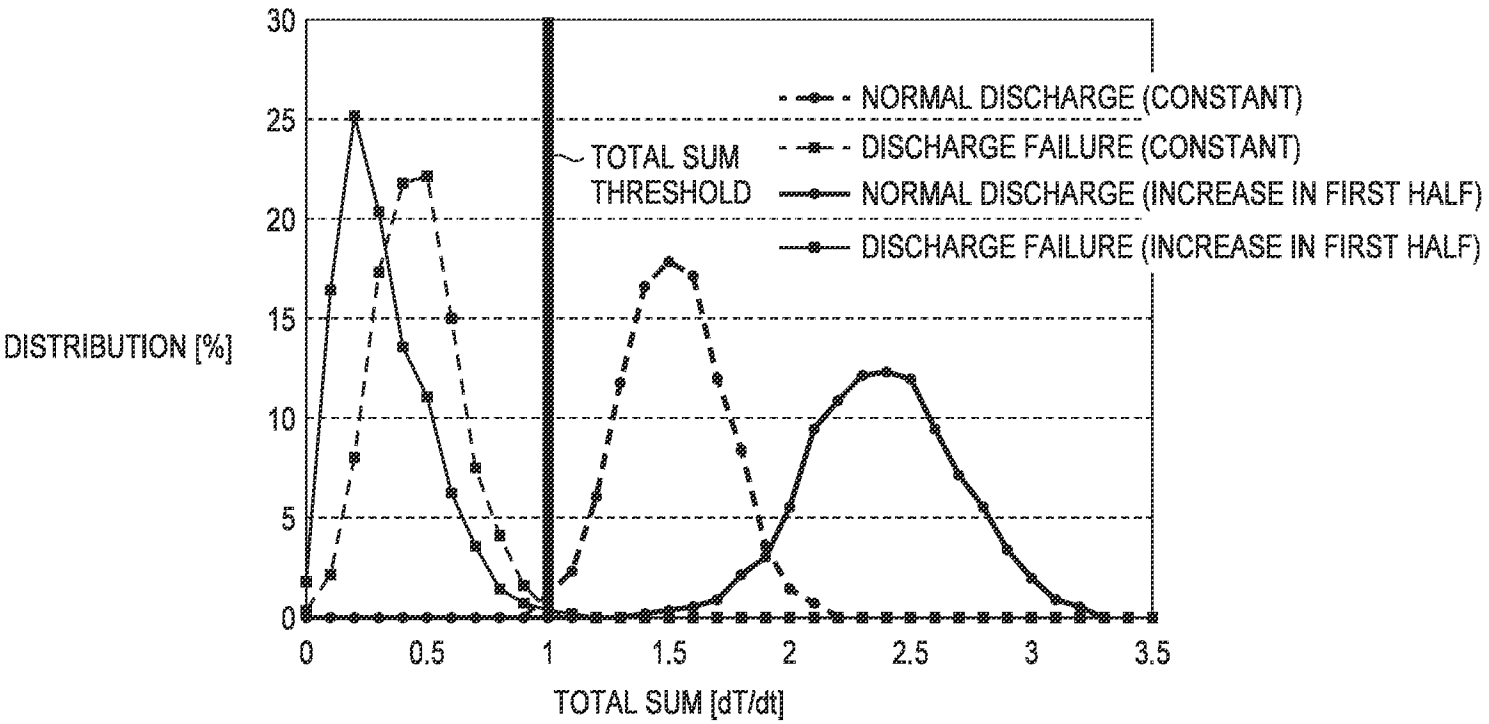
FIG. 12 is a graph showing the distribution of total sums when noise is superimposed on the second derivative of the temperature change in the discharge failure shown in FIG. 9.

FIG. 12 is a graph showing the distribution of total sums when noise is superimposed on the second derivative of the temperature in respect with a time in the discharge failure shown in FIG. 9. Regarding the waveform of the second derivative, the total sums of the coefficients (Ai=2*(1−i/(k−2)) whose addition ratio is made lower from the first half toward the second half of the extraction interval concentrate to values smaller than the total sum of coefficients (Ai=1) that are constant throughout the first half and the second half. When the total sums at the time of a discharge failure concentrate to small values, the probability that discharge failure is erroneously judged as normal discharge because of the second derivative larger than the total sum threshold decreases. Note that i=0, 1, 2, . . . , k−2.

If the feature point variation is small, the extraction interval is set to a point where the second derivative of the temperature in respect with a time in normal discharge and that in a discharge failure intersect, as shown in FIG. 9. This allows to not only decrease the total sum in the discharge failure in which the value of the second derivative of the temperature in respect with a time becomes small along with the elapse of time but also increase the total sum in normal discharge in which the value of the second derivative of the temperature in respect with a time becomes large along with the elapse of time.

Hence, according to the above-described embodiment, the total sum difference between discharge failure and normal discharge becomes large, and more accurate judgment is possible.

When detecting a nozzle of normal discharge, for a feature point that appears at the time of normal discharge, the total sum may become small because of noise superimposition or a decrease in the peak value.

Figure 13:
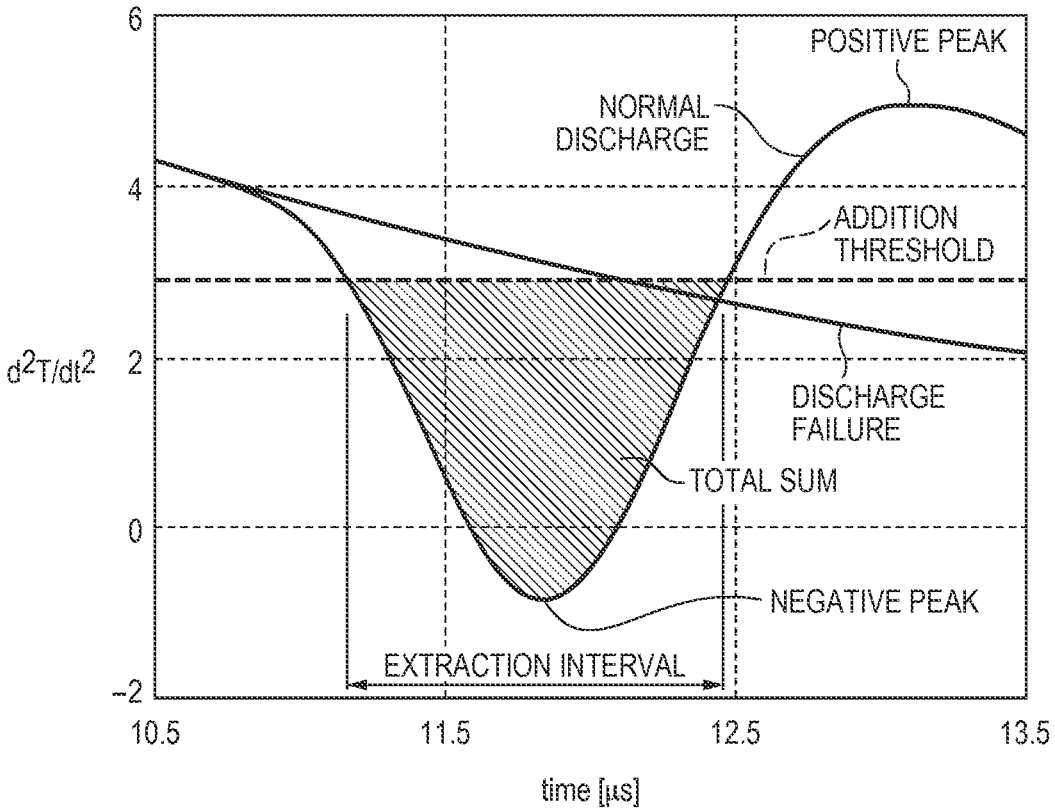
FIG. 13 is a graph showing the temporal change in the second derivative of the temperature in respect with a time when the timing at which a feature point appears is optimum with respect to the extraction interval.

FIG. 13 is a graph showing the temporal change in the second derivative of the temperature in respect with a time when the timing at which a feature point appears is optimum with respect to the extraction interval. According to this graph, the value of the second derivative of the temperature in respect with a time at the time of normal discharge becomes large on both sides of the negative peak. For this reason, setting the negative peak at the center of the extraction interval enables to increase the total sum (dT/dt). That is, the addition portion is made higher at the center of the extraction interval than in the first half or second half, thereby increasing the total sum at the time of normal discharge.

Figure 14:
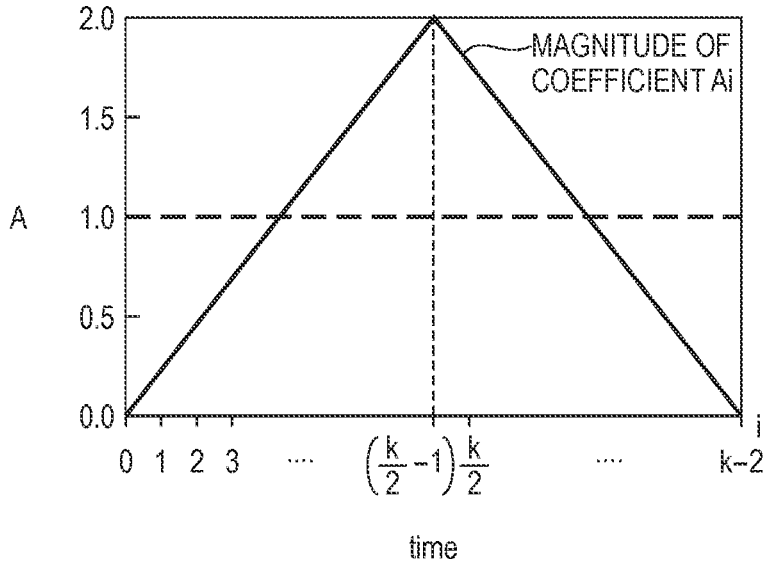
FIG. 14 is a graph showing an example of coefficients when making the addition ratio higher at the intermediate point than in the first half or the second half of the extraction interval.

FIG. 14 is a graph showing an example of weighting coefficients when making the addition portion higher at the intermediate point than in the first half or the second half of the extraction interval. According to FIG. 14, at the intermediate point of the extraction interval, the second derivative of the temperature in respect with a time is added at a ratio twice the median (1.0) of the weighing coefficients. However, the second derivative of the temperature in respect with a time is added at a ratio 0th times the median at the start and end of the extraction interval. In addition, as for the addition portion for the second order differential waveform data in the entire extraction interval, the coefficients A0, A1, A2, . . . , Ak−2 are decreased from the intermediate point toward the first half and the second half of the extraction interval along with the time with respect to the second order differential waveform data D0, D1, D2, . . . , Dk−2. That is, Ai=4*(i/(k−2)) (i=0, 1, . . . , k/2−1) in the first half, and Ai=−4*(i/(k−2))+4 (i=k/2, k/2+1, k/2+2, . . . , k−2) in the second half.

Figure 15:
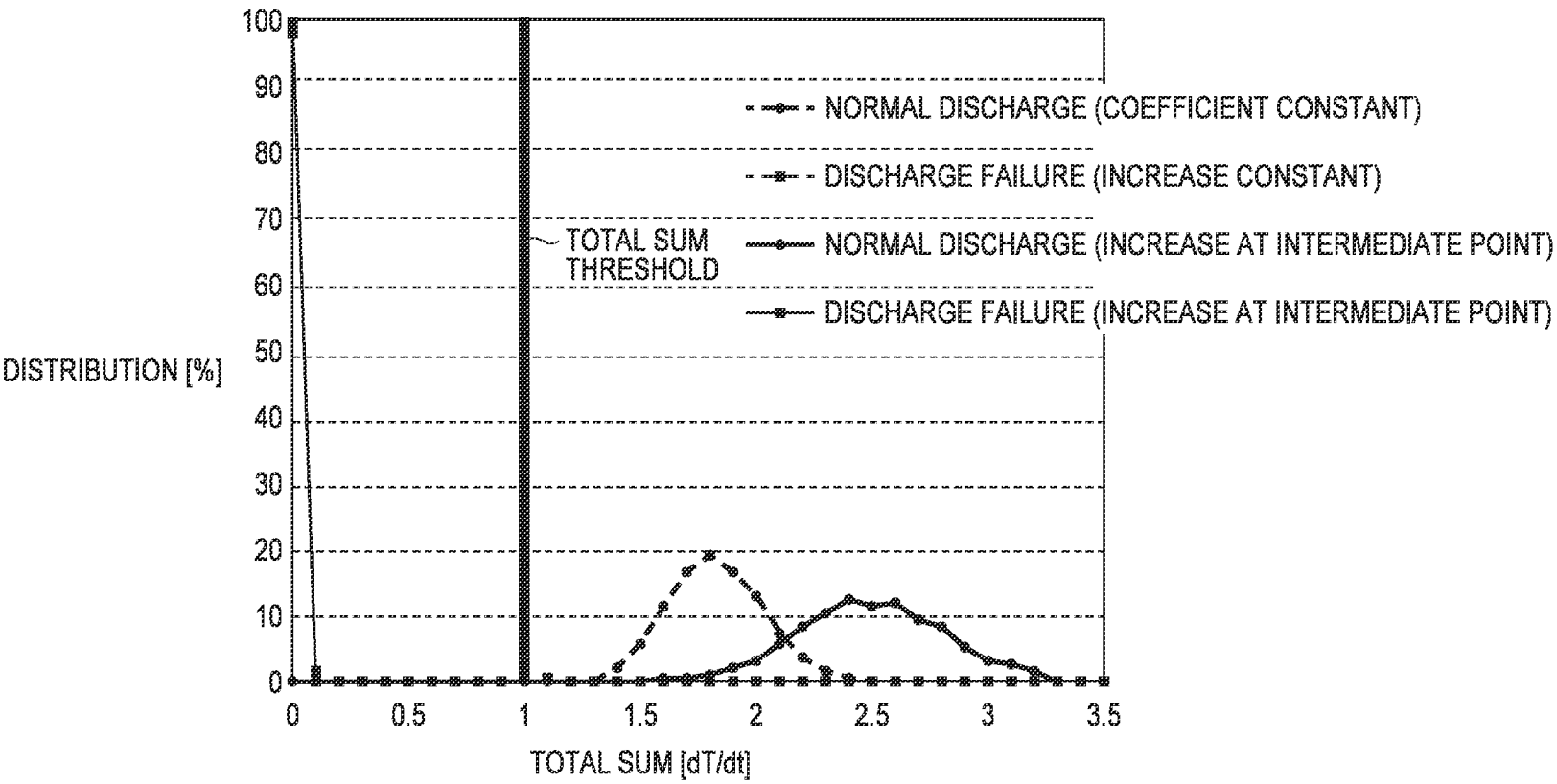
FIG. 15 is a graph showing the distribution of total sums when noise is superimposed on the second derivative of the temperature change in the normal discharge shown in FIG. 13.

FIG. 15 is a graph showing the distribution of total sums when noise is superimposed on the second derivative of the temperature in respect with a time in the normal discharge shown in FIG. 13. Regarding the waveform of the second derivative, the total sums of the coefficients (first half: Ai=4*(i/(k−2)), and second half: Ai=−4*(i/(k−2))+4) whose addition proportion is made higher at the intermediate point than in the first half or second half of the extraction interval concentrate to values larger than the total sum of coefficients (Ai=1) that are constant from the first half to the second half. Note that i=0, 1, 2, . . . , k/2−1 for the first half, and i=k/2, k/2+1, k/2+2, . . . , k−2 for the second half. For the constant coefficients, i=0, 1, 2, . . . , k−2.

Hence, according to the above-described embodiment, since the total sums at the time of normal discharge concentrate to large values, the probability that the normal discharge is erroneously judged as a discharge failure because of the second derivative larger than the total sum threshold decreases.

Note that in the first and second embodiments, the distribution of total sums at the time of normal discharge and at the time of the discharge failure can be controlled by arbitrarily changing the coefficient to change the addition amount, as a matter of course.

Additionally, in the first and second embodiments, the degree of contribution to the feature of each waveform on the total sum can be controlled by setting coefficients that take advantage of the feature of the waveform data of the second derivative of the temperature in respect with a time at the time of normal discharge and at the time of the discharge failure. In the first and second embodiments described above, the coefficients are set based on the waveform data of the second derivative. As another example, the coefficients may be set based on temperature data. For example, the coefficients may be set based on the data in the dropping process of the temperature detected by a temperature sensor 105.

Furthermore, in the first and second embodiments, not only the normal discharge and the discharge failure but also the timing at which a feature point appears or the correctness of the addition threshold or extraction interval can be judged from the change in the magnitude of the total sum that occurs when the coefficients are changed.

Third Embodiment

In the first and second embodiments, the first method is used. In the third embodiment, however, an example using the second method will be described.

Figure 16:
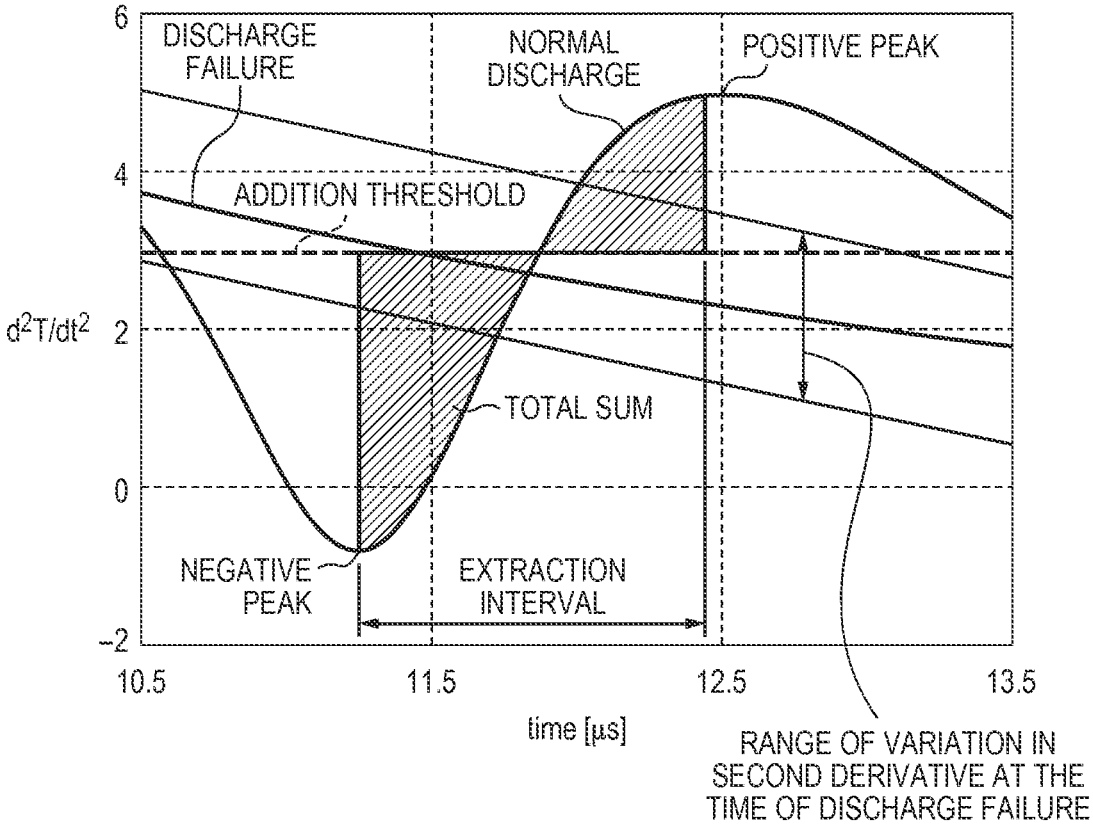
FIG. 16 is a graph showing the relationship between a total sum threshold and the second derivatives ($d^2T/dt^2$) of the temperatures detected by a temperature sensor 105 in respect with a time at the time of normal discharge and at the time of a discharge failure occurrence according to the second method.

FIG. 16 is a graph showing the relationship between an addition threshold and the second derivatives ($d^2T/dt^2$) of the temperatures detected by a temperature sensor 105 in respect with a time at the time of normal discharge and at the time of a discharge failure occurrence according to the second method.

Figure 17:
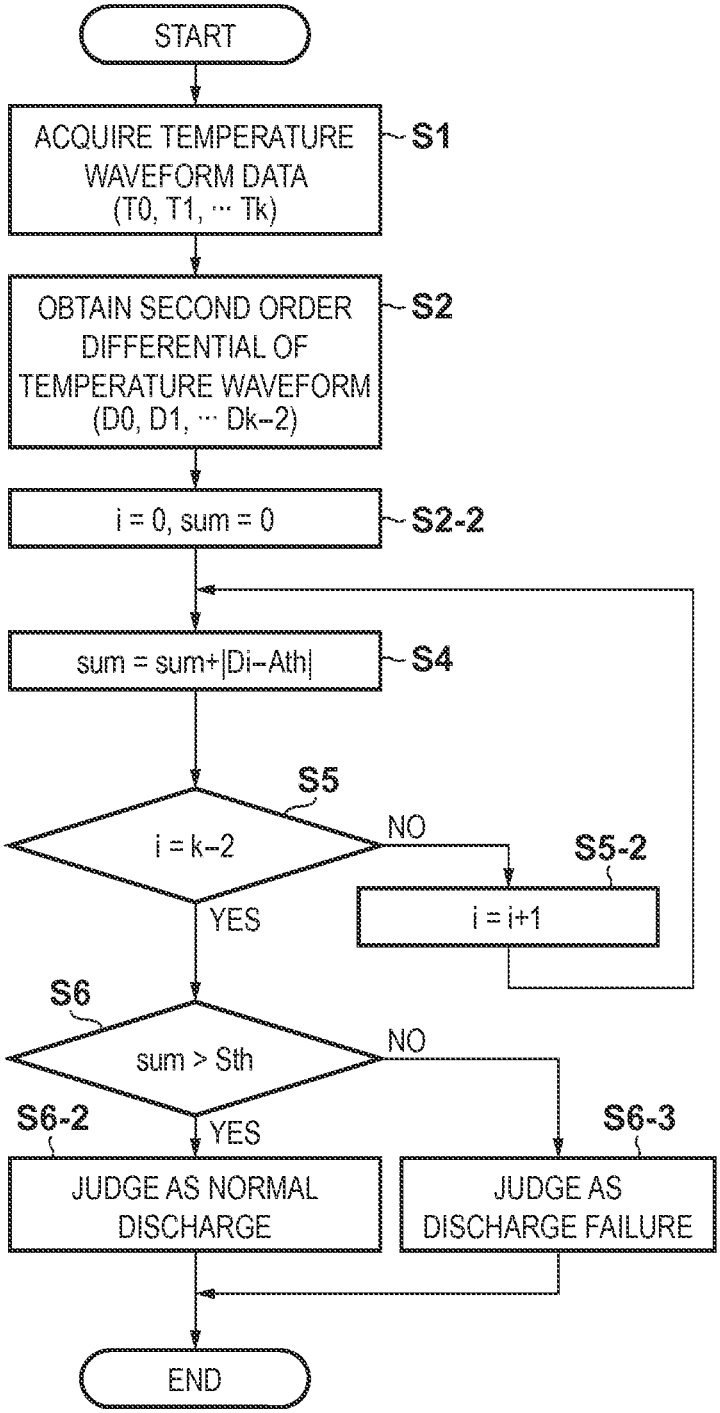
FIG. 17 is a flowchart showing a discharge state judgment procedure according to the second method.

FIG. 17 is a flowchart showing a discharge state judgment procedure according to the second method. FIG. 17 is different from the flowchart of FIG. 8 illustrating the procedure according to the first method in that step S3 in which a second derivative is compared with the addition threshold is excluded. Hence, the second method is more advantageous than the first method in reducing the calculation load of the discharge state judgment processing. The remaining steps are the same as in FIG. 8. The steps are denoted by the same step numbers as in FIG. 8, and a description thereof will be omitted.

Hence, according to the above-described embodiment, the same effects as in the first and second embodiments can be obtained.

An example in which the present invention is applied to a printing apparatus for performing serial printing has been described above. However, the present invention is also applicable to a printing apparatus using a full-line printhead, as a matter of course. In such a printing apparatus, not only the printing operation is very fast, but also recovery processing cannot be performed by locating the printhead on the recovery unit during the series of printing operations. Hence, the present invention is effective for quickly specifying a nozzle in which discharge failure has occurred during preliminary discharge into the cap or during the printing operation and promptly performing recovery processing or complementary printing using another full-line printhead.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-261004, filed Nov. 29, 2011, which is hereby incorporated by reference herein in its entirety.

What is claimed is:

1. A printing apparatus comprising:

a printhead including a heater configured to generate heat energy to discharge ink, and a temperature sensor configured to detect a temperature;

a driving unit configured to drive said heater;

a monitoring unit configured to monitor a temporal change in the temperature detected by said temperature sensor when said driving unit drives said heater;

an extraction unit configured to, in a temperature dropping process in a driving period of said heater monitored by said monitoring unit, extract temperatures at a plurality of points of a predetermined time interval including a timing at which a feature point of the temporal change, in the temperature detected by said temperature sensor, which occurs when the ink is normally discharged by driving said heater, appears;

an arithmetic unit configured to calculate a second derivative of the temperature extracted by said extraction unit with respect to time;

an addition unit configured to acquire a total sum of values of second derivatives calculated by said arithmetic unit, which are weighted in accordance with an elapse of time; and a judgment unit configured to judge, based on a predetermined first threshold and the total sum acquired by said addition unit, whether normal discharge is obtained, or discharge failure has occurred.

2. The apparatus according to claim 1, wherein said addition unit includes a selection unit configured to compare the value of the second derivative calculated by said arithmetic unit with a predetermined second threshold and select the second derivative having a value smaller than the predetermined second threshold as a target of the addition.

3. The apparatus according to claim 1, wherein a value of a coefficient for the weighting has a characteristic of decreasing along with time.

4. The apparatus according to claim 1, wherein a value of a coefficient for the weighting has a characteristic of having a maximum value at a center of the predetermined time interval and decreasing from the center toward a preceding time and a subsequent time.

5. The apparatus according to claim 1, wherein said printhead is a full-line printhead.

6. The apparatus according to claim 1, further comprising a scan unit configured to reciprocally scan a carriage on which said printhead is mounted.

* * * * *